United States Patent [19]

Finger

[11] Patent Number: 4,949,484

[45] Date of Patent: Aug. 21, 1990

[54] CARD HOLDING, CARRYING AND RETAINING SYSTEM AND SPECIALIZED HOUSING AND CARRYING MEMBER THEREFOR

[76] Inventor: Julie Finger, 725 - 1/4 N. Alfred St., Los Angeles, Calif. 90069

[21] Appl. No.: 424,593

[22] Filed: Oct. 20, 1989

Related U.S. Application Data

[63] Continuation of Ser. No. 109,770, Oct. 16, 1987, abandoned, which is a continuation-in-part of Ser. No. 29,735, Mar. 24, 1987, abandoned.

[51] Int. Cl.[5] ..... B42F 21/00; B65D 27/00

[52] U.S. Cl. ..... 40/359; 40/360; 281/15.1; 402/79; 312/183

[58] Field of Search ..... 40/404, 405, 378, 379, 40/388, 389, 359, 360, 393, 394, 395, 372–376, 530, 536, 124.2, 537, 124; 402/63, 75, 77, 79, 80 R, 80 P, 500–502; 281/29, 31, 25, 15, 17; 283/55, 54, 52, 56, 57, 61–63, 64; 211/42; 312/183, 184, 185, 233; 282/26, 29 R, 2

[56] References Cited

U.S. PATENT DOCUMENTS

| | | | |
|---|---|---|---|
| 740,321 | 9/1903 | Shaul | 40/124 |
| 1,272,149 | 7/1918 | Thompson | 40/360 |
| 1,567,406 | 12/1925 | Wilke | 402/79 |
| 1,867,218 | 7/1932 | Hanson | 402/2 |
| 2,108,015 | 2/1938 | Kalish | 281/29 |
| 2,573,323 | 10/1951 | Eshelman | 281/15 B |
| 3,221,751 | 12/1965 | Brandon | 402/75 |
| 3,408,126 | 10/1968 | Mortensen | 312/183 |
| 3,662,481 | 5/1972 | Lewis, Jr. | 40/124 |
| 3,930,700 | 1/1976 | Figueres | 40/159 |
| 3,970,397 | 7/1976 | Armstrong | 402/79 |
| 4,124,261 | 11/1978 | Klaus | 312/184 |
| 4,643,452 | 2/1987 | Chang | 402/500 |

FOREIGN PATENT DOCUMENTS

| | | | |
|---|---|---|---|
| 605290 | 5/1926 | France | 40/388 |
| 9591 | of 1895 | United Kingdom | 312/183 |

*Primary Examiner*—Kenneth J. Dorner
*Assistant Examiner*—J. R. Hakomaki
*Attorney, Agent, or Firm*—Thomas I. Rozsa

[57] ABSTRACT

The present invention relates to an improved system whereby a business card can be immediately placed onto a card holding means which permits the card to be immediately stored in a card carrying means which can be carried in a coat pocket or purse and further upon return to one's office permits the business card to be immediately removed from the card carrying means and placed in a desk card retaining means such as a card file or rotary file without any need for physical alteration of the business card to transcription of the information from the business card to the filing card. In addition, the present invention further permits the business card to be removed from the desk card holder and placed in the carrying case for use when the individual is going to a meeting with that person, thereby eliminating the necessity of once again transcribing the information from the card in the desk card holder onto a piece of paper to be taken by the individual to the meeting. The present invention further relates to a novel housing member for retaining the desk card holder in which the retained cards are placed and further relates to a novel carrying member for retaining a series of card holding members for use during a business trip. The present invention also relates to business card retaining means which can be used in conjunction with conventional organizers and planners.

6 Claims, 4 Drawing Sheets

Fig. 6.
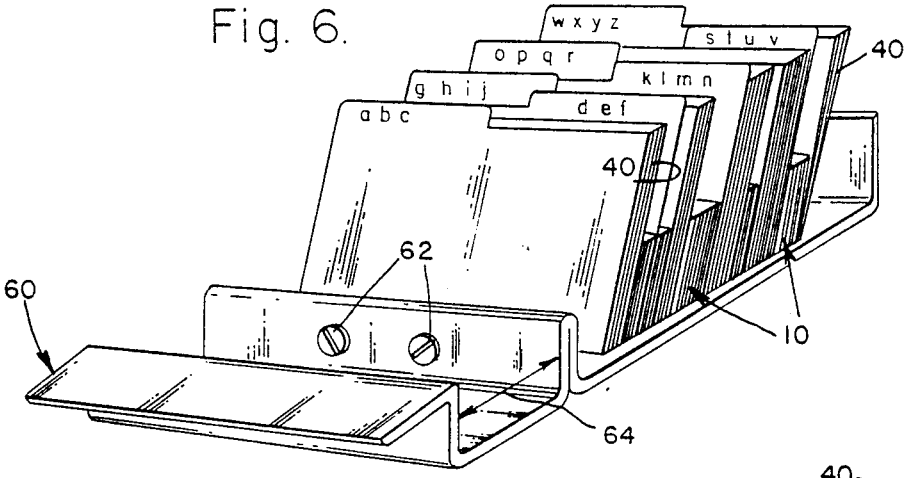
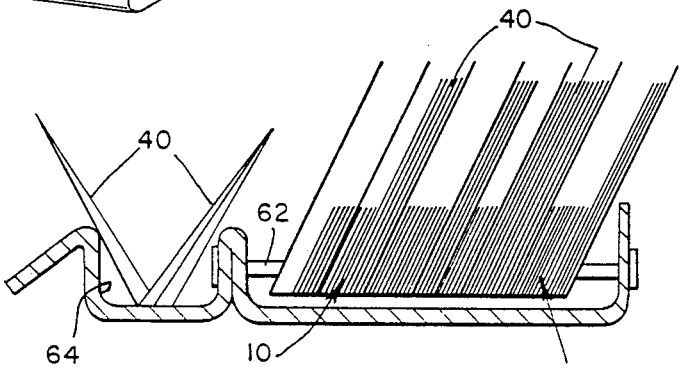
Fig. 7.
Fig. 8.
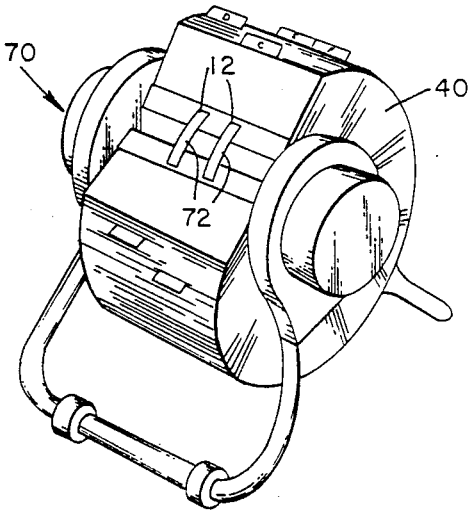
Fig. 4.
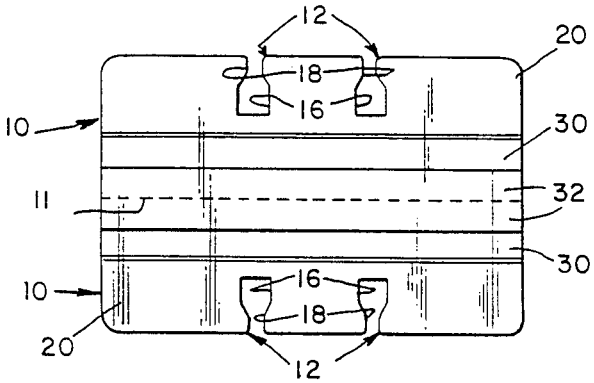

CARD HOLDING, CARRYING AND RETAINING SYSTEM AND SPECIALIZED HOUSING AND CARRYING MEMBER THEREFOR

The present application is a continuation of pending application Ser. No. 07/109,770 filed on 10/16/87 which in turn is a continuation-in-part of co-pending application Ser. No. 07/029,735 filed 03/24/87 for Card Holding, Carrying And Retaining System, which application is still being prosecuted concurrently with this application as Continuation application Ser. No. 07/293,690 filed 01/05/89.

BACKGROUND OF THE INVENTION

1. Field of the Invention

The present invention relates to an improved card holding, carrying and retaining system by which an individual can efficiently collect and mount cards such as a business card immediately upon receipt of the card during meetings, conventions, etc. and thereafter employ the mounting means to carry the card so that it will not be mutilated, misplaced or lost and thereafter upon return home or to his or her place of business immediately transfer the card to a retaining means such as a business card file box or a rotary file holder. The present invention further relates to a novel housing member for retaining the tray in which the retained cards are placed and further relates to a novel carrying member for retaining a series of card holding members for use during a business trip. The present invention also relates to business card retaining means which can be used in conjunction with conventional organizers and planners.

2. DESCRIPTION OF THE PRIOR ART

In general, card filing systems are well known in the prior art. Conventionally, a multiplicity of filing cards are placed in a filing card retaining means. Conventional filing card retaining means include a tray or a wheel in which the filing cards are place, such as those manufactured by Eldon or by Rolodex respectively. The tray card holder or rotary card holder includes one or more card holding means such as tracks, rails, cylindrical rods, etc. onto which the filing cards are movably inserted. The filing cards, in turn, having mating slots adjacent their lower edge by which the cards may be movably and removably inserted onto the tracks, rails, rods, etc of the card holding means.

When people attend a business meeting, a trade show or a convention, they frequently receive a large number of business cards from individuals with whom they may be negotiating a transaction or who they meet at a trade show or convention. Many times these individuals may be prospective customers or clients. The cards are frequently placed in a coat pocket or purse and may thereafter be wrinkled, torn, misplaced or lost. In addition, assuming the business cards are brought back to the office, they are frequently placed in a desk drawer where they are forgotten. Alternatively, if the newly acquired business cards are maintained in a safe place and are brought back to the office, the information from the cards must be transmitted to the filing card system. One alternative is to transcribe the information from the business card onto the filing card. In addition to taking extra time to do this work with each business card, information may be incorrectly transcribed, leading to greater problems and a waste of time in locating the correct information. In an alternative process, the business card may be somehow attached to the filing card such as by tape or staples. Since the business card is usually about the same height as the filing card and an allowance must be made for the slots by which the filing card is movably attached to the tracks in the card holder, the business card is often too tall for the card holder trays, thereby preventing the tray from being closed. It is therefore necessary to cut the business card so that it fits onto the filing card so that the tray can be closed while at the same time not interfering with the slots at the lower edge of the filing card. Since telephone numbers and/or addresses are frequently placed adjacent the top or bottom of the card, this information is cut off and therefore must be written onto the body of the card.

Some Rolodex type trays have a closing lid to prevent the cards from getting dirty. Others, are left exposed. In embodiments where the cards are inserted onto a carrying tray, the tray itself does not include an appropriately fitted housing member so that the cards may be stored and thereby reduce the likelihood that they will become soiled.

When a businessperson wishes to go on a business trip, it is necessary for him or her to copy down the address from the business card or alternatively remove the card from the card holding file and place it in his or her wallet or briefcase (or pocket book). If the individual is a salesperson and must make frequent calls to a large number of customers or potential customers, this becomes a significant chore. In addition, there is a significant risk that the cards may becomes lost or soiled.

Loose-leaf type business organizers and planners have become very popular. Business cards are not conveniently stored in such organizers and are merely fitted into a slot therein from which they can fall out or become creased or soiled.

Therefore, the card filing systems known in the prior art all suffer from the same defects. Business cards can be dirtied, torn, lost or mislaid when received and if they are brought back to the office intact, they must be physically modified before they can be placed onto the filing card or information must be taken from the business card and written onto the filing card. In open tray type card holders (which are the most convenient), the prior art systems provide no housing with a matched fitting to the tray to keep the cards safe and to prevent them from getting dirty or from be soiled (such as coffee being spilled on them). In addition, no prior art system provides an efficient method by which a selected number of the business cards can be removed and taken on a trip, which system at the same time assures that the business cards will be kept safely and be prearranged in a given selected order or other system.

Therefore, there is a significant need for a product which permits a business card to be immediately mounted upon receipt and thereafter safely carried so that it will not become disfigured or lost and which further permits the card to be immediately inserted onto the tracks of a card file without any further work involved.

There further exists a significant need for a system by which business cards can be efficiently mounted, collected and safely stored when received and thereafter instantly inserted into a card holder or tray upon the individual's return to the office without a need for modifying the card in any way or transcribing information from the business card onto the filing card.

There is also a significant need for a system by which cards mounted in an open tray can be protected through a protecting housing member when the cards and tray are not in use. There is also a need for a system by which a multiplicity of the protective housing members can be stacked or mounted on a wall unit, for more efficient use.

There is additionally a significant need for an organizing and carrying system to selectively carry a group of business cards on a trip in a specific safe and organized manner.

There is a further significant need for efficiently carrying business cards in a loose-leaf type business planner or organizer.

SUMMARY OF THE PRESENT INVENTION

The present invention relates to an improved system whereby a business card can be immediately placed onto a card holding means which permits the card to be immediately stored in a card carrying means which can be carried in a coat pocket or purse and further upon return to one's office permits the business card to be immediately removed from the card carrying means and placed in a desk card retaining means such as a card file or rotary file without any need for physical alteration of the business card or transcription of the information from the business card to the filing card.

The present invention additionally relates to a housing member which perfectly matches the desk card retaining means to keep the cards and desk card retaining means or tray covered when not in use to thereby assure that the cards and tray will not become dirty by means such as food or drink being spilled on them. The matching housing member further includes features such as a tray to retain cards before they are alphabetically filed in the desk card retaining means.

The present invention further relates to a matching case member which permits a multiplicity of card carrying means to be stored and carried in a preselected order. As a result, if it is desired to select a group of cards retained by the present invention card holding means and carrying them on a business trip, the user can remove the business cards and associated card holding means from the card retaining means and place them in the card carrying means. If it is desired to have a preselected group of card carrying means on the trip so that each card carrying means contains a group of cards for businesses or individuals to be called on during a given period of time or a given location, the matching case member can hold a multiplicity of card carrying members in a preselected order with the associated preselected business cards therein. In this way, a business trip can be efficiently organized with the cards for individuals or business to be called on in a given morning placed in one card carrying means and the cards for individuals or businesses to be called on in the afternoon and during future days to be placed in selected additional card carrying means.

In addition, the present invention further permits the business card to be removed from the card retaining means and placed in the card carrying means for use when the individual is going to a meeting with that person, thereby eliminating the necessity of once again transcribing the information from the card in the card retaining means onto a piece of paper to be taken by the individual to the meeting.

It has been discovered, according to the present invention, that use of a card holding means or strip means comprising at least one slot adjacent one edge for movable mating engagement with the rail or track of a card carrying means or card retaining means and a self adhesive section along one face of the card holding means which self adhesive section may be protected by a removable covering means, enables a user to quickly affix a business card to the card holding means by removal of the covering strip and pressing the back of the business card adjacent the self adhesive section. This assembly thereby permits an individual to have a means for retaining a business card in a multiplicity of locations such as a card carrying means or card retaining means.

It has further been discovered that if a card carrying means such as a case comprising at least one rod or track capable of movably and removably receiving the at least one slot of the card holding means is used in conjunction therewith, then upon affixation of the business card to the card holding means, the card holding means can be retained in the card carrying means or case by insertion of the slot or slots in the card holding means onto a respective one of the track or tracks in the case.

It has additionally been discovered, according to the present invention, that if a card retaining means such as a tray or rotary file (for example an Eldon file tray or Rolodex Rotary File) comprising at least one track or rod which movably and removably accommodates the slot or slots in the card holding means is used in conjunction therewith, then upon return to the office or other location where the card retaining means is kept, the strip means and the business card affixed thereto can be removed from the card carrying means and transferred to the card retaining means.

In addition, if it is desired to remove the business card for use in a future trip to that individual, the card can be easily removed from the card retaining means and placed in the card carrying means or case which is carried to the meeting.

It has also been discovered that if the card retaining means is an open tray configuration, a matching housing member which permits the card retaining means or tray to removably slide within the housing member provides an efficient means to keep the cards and associated tray clean. If the housing member includes a storage tray, cards can be placed in the tray and later filed in the card retaining means when time permits.

It has also been discovered that if at least one and preferably a pair of openings are placed in the rear wall of the matching housing member, the matching housing member can be mounted on a wall for ready access.

It has further been discovered that if non-slip members such as Bumpons~ (a Trademark of 3M Corporation) are placed on the floor or base of the housing member, the housing members can be stacked one on top of the other. In addition, if such Bumpons~ are placed on the bottom of the card retaining member, the Bumpons~ facilitate more easy use and non-slippage of the card retaining member.

It has additionally been discovered that a matching case member including a multiplicity of preformed slots for individually retaining a multiplicity of card carrying means provides an ideal means for carrying a multiplicity of card carrying means containing a multiplicity of preselected cards in each card carrying means, to thereby efficiently organize a business trip.

It has additionally been discovered that if two card retaining means are placed side by side on a backing member which incorporates a selected series of holes to enable the backing member to be inserted in a loose-leaf type book, the card retaining means of the present invention can be used in conjunction with conventional business planners or organizers in loose-leaf form.

It is therefore an object of the present invention to provide a business card holding means such as a strip whereby the card can be permanently affixed to the strip so that it can be movably and removably retained in a card carrying case or card retaining file.

It is a further object of the present invention to provide a business card retaining system whereby the card can be immediately affixed to a card holding means or strip which permits the card to be movably and removably inserted in and carried in a card carrying means such as a card carrying case from which it can be removed and movably and removably inserted in a card retaining means such as a tray file (either open or with a closing top) or rotary file (such as a Rolodex), all without the necessity of altering the physical shape of the card or transcribing information from the card onto another piece of paper such as a filing card.

It is another object of the present invention to substantially eliminate the possibility of mutilating or losing business cards or other cards or incorrectly transcribing information from the cards onto another piece of paper.

It is an additional object of the present invention to provide a matching housing member for open card retaining means to thereby enclose the card retaining means when not in use and further provide a means for storing unfiled cards in an efficient and safe manner so that they may be later filed when time permits.

It is another object of the present invention to provide a means by which housing members may be stacked one on top of the other and/or by which housing members may be mounted on a surface such as a wall.

It is an additional object of the present invention to provide a case means for carrying a multiplicity of card carrying means in a preselected order.

It is another object of the present invention to provide an embodiment of a card retaining means which can be used in conjunction with conventional business planners or organizers in loose-leaf form.

Further novel features and other objects of the present invention will become apparent from the following detailed description, discussion and the appended claims taken in conjunction with the drawings.

DRAWING SUMMARY

Referring particularly to the drawings for the purpose of illustration only and not limitation, there is illustrated:

FIG. 4 is an elevational view of two card holding means detachably affixed to each other along one lengthwise edge by a perforated central strip.

Figure 5:
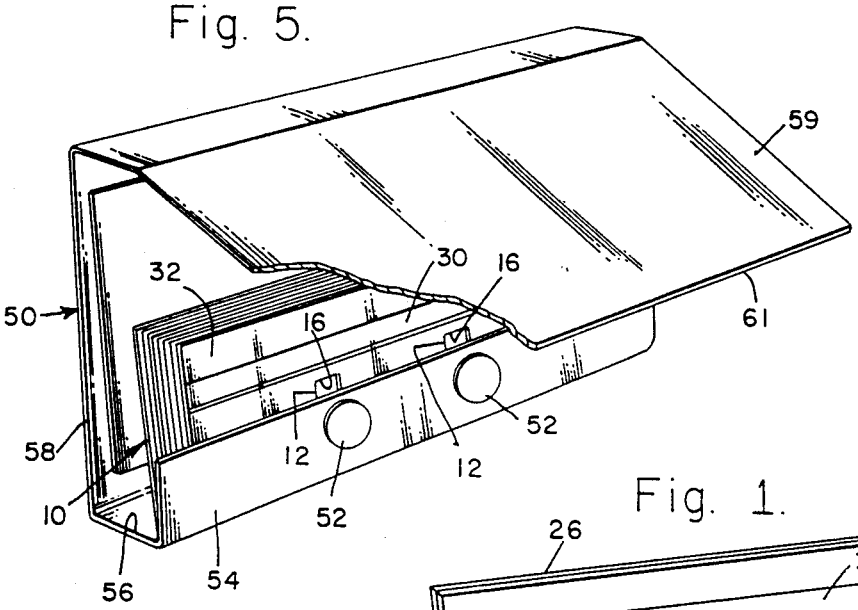
Figure 1:
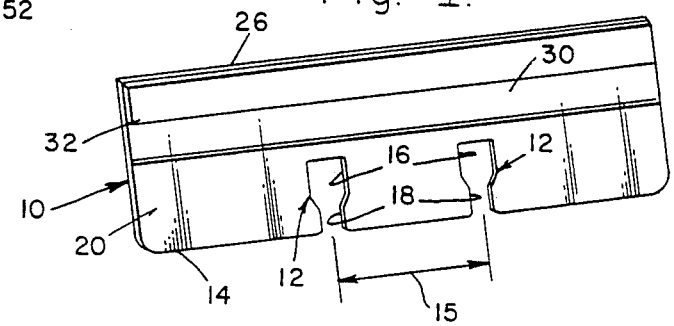
FIG 1 is a perspective view of the a card holding means of the present invention such as a strip member, with the self adhesive section completely covered by a covering strip.
Figure 2:
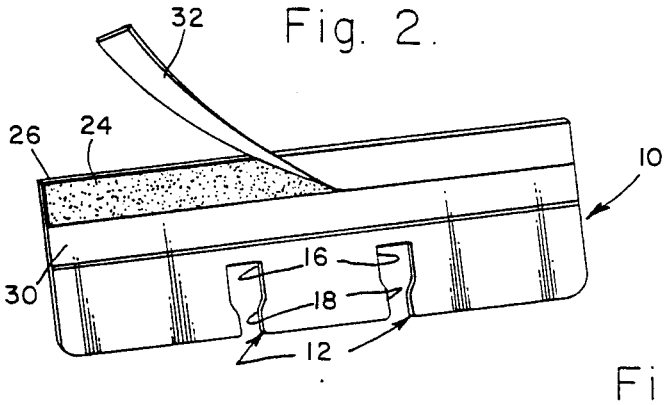
FIG. 2 is a perspective view of the card holding means illustrated in FIG. 1, with a portion of the covering strip peeled away to disclose the self adhesive section.
Figure 3:
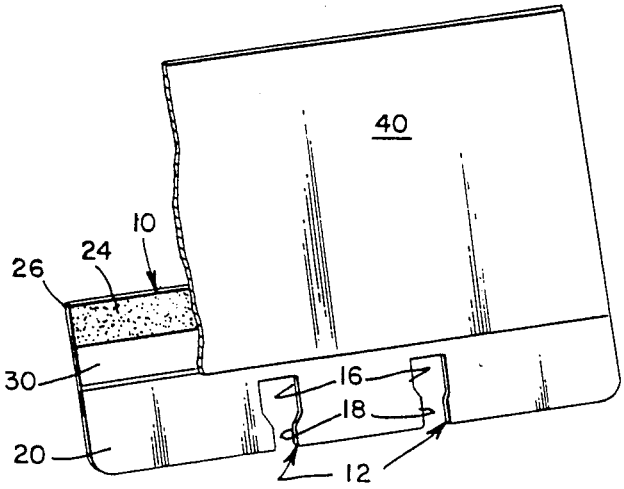
FIG. 3 is a perspective view of a card holding means such as a strip member and a fragmentary view of a card affixed to the strip member.

FIG. 5 a perspective view of a card carrying means such as a card carrying case used in conjunction with the card holding means illustrated in FIGS. 1 through 3 movably and removably inserted therein.

FIG. 6 is a perspective view of a card retaining means such as a card file tray, with the card holding means movably and removably inserted therein.

FIG. 7 is a longitudinal cross-sectional view taken along line 7—7 of FIG. 6.

FIG. 8 is a perspective view of a rotary card retaining means such as a Rolodex file, with the card holding means movably and removably inserted therein.

Figure 9:
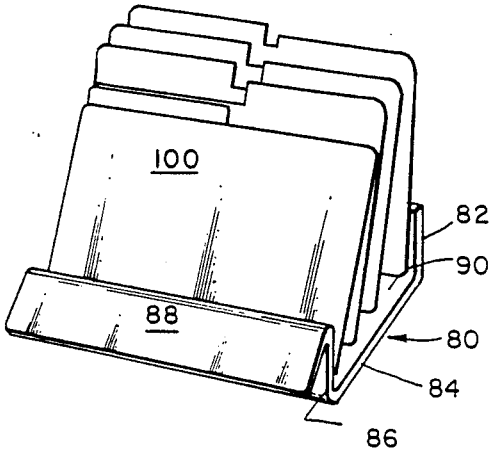
Figure 11:
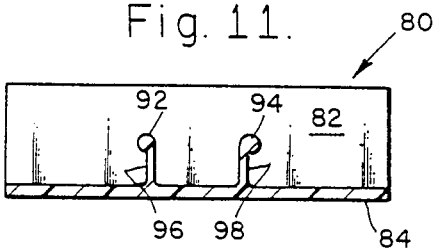
Figure 10:
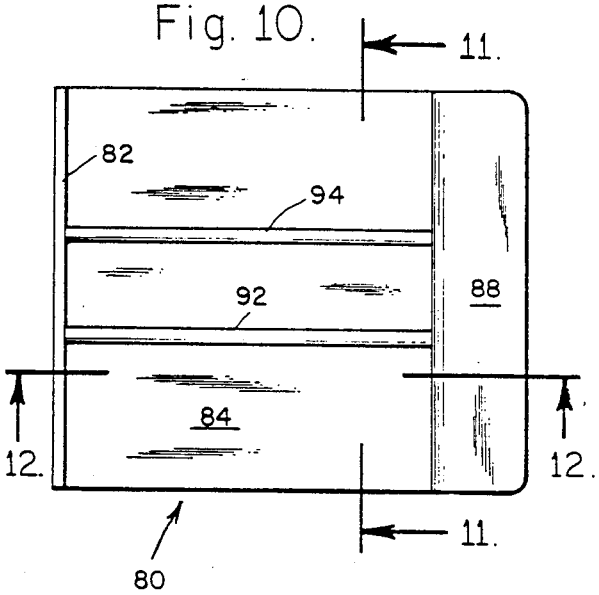

FIG. 9 is a perspective view of an alternative embodiment of an open card retaining means such as a card file tray, with the card holding means movably and removably inserted therein., FIG. 10 is a top plan view of the card retaining means illustrated in FIG. 9, with the card holding means and associated business cards removed FIG. 11 is a cross-sectional view of the card retaining means illustrated in FIG. 9, taken along line 11—11 of FIG. 10, to thereby illustrate the rails on which the card holding means are retained.

Figure 12:
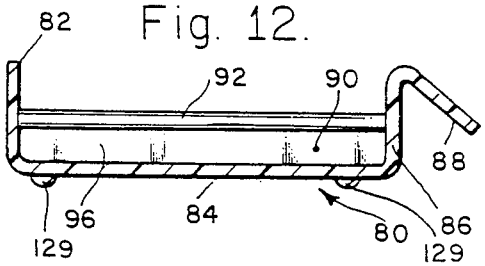

FIG. 12 is a cross-sectional view of the card retaining means illustrated in FIG. 9, taken along line 12-12 of FIG. 10, to thereby illustrate a longitudinal view of one of the rails and the handle member by which the card retaining means is moved.

Figure 13:
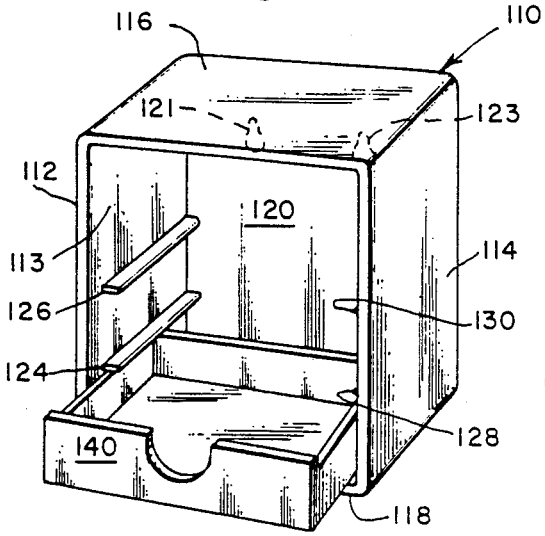

FIG. 13 is a perspective view of a card retaining meanings housing member including a slidable tray member therein for retaining unfiled business cards.

Figure 14:
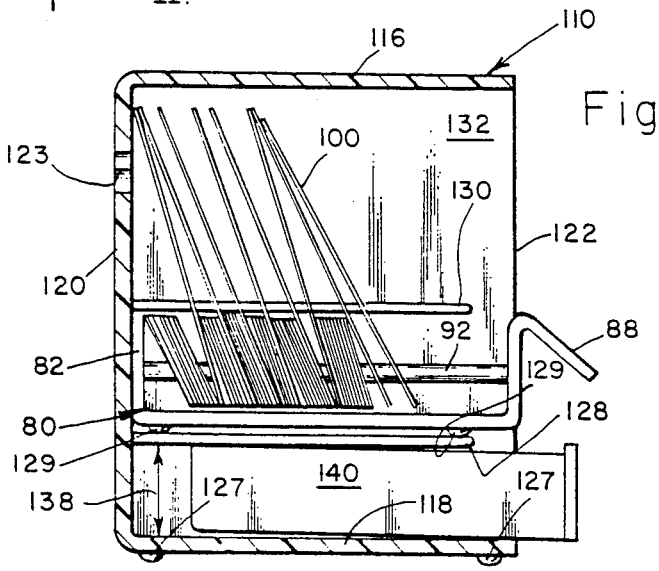

FIG. 14 is a longitudinal cross-sectional view of the housing member illustrated in FIG. 13, with a card retaining means and associated card holding means and business cards retained therein as well as the slidable tray for retaining unfiled business cards retained therein, to illustrate the relationship between (i) the rail means for slidably receiving the card retaining means within the housing member, (ii) the lower portion of the housing member which slidably receives the card holding tray and (iii) the clearance provided for the business cards carried in the card retaining means after it is inserted into the housing member.

Figure 15:
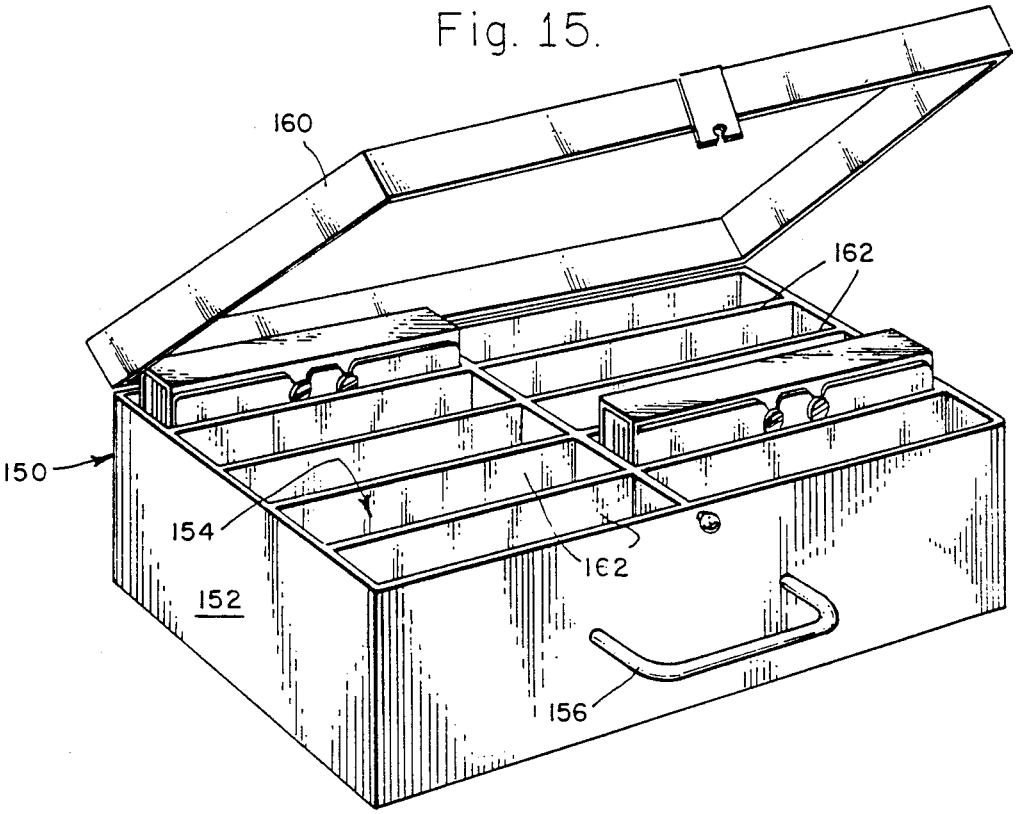

FIG. 15 is a perspective view of a case means for carrying a multiplicity of card retaining means in a preselected order, illustrating two card retaining means carried therein.

Figure 16:
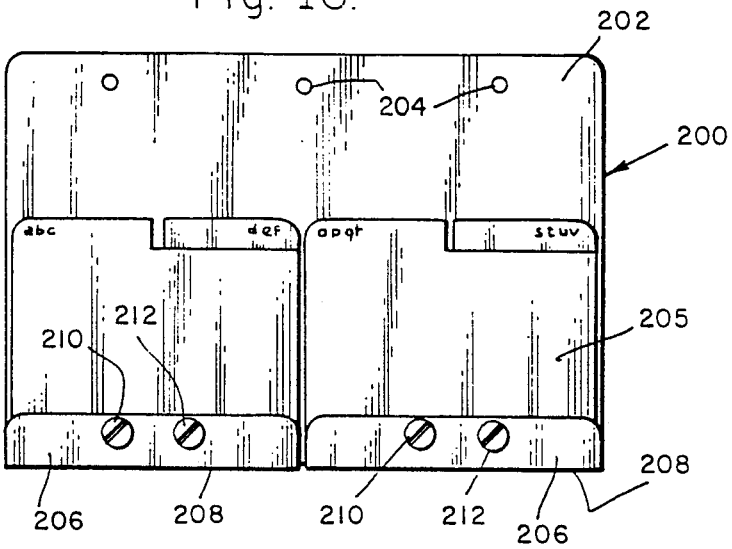

FIG. 16 is an alternative embodiment of a card retaining means for use in conjunction with a business planner.

DETAILED DESCRIPTION OF THE PREFERRED EMBODIMENT

Although the apparatus and method of the present invention will now be described with reference to specific embodiments in the drawings, it should be understood that such embodiments are by way of example and merely illustrative of but a small number of the many possible specific embodiments which can represent applications of the principals of the invention. Various changes and modifications obvious to one skilled in the art to which the invention pertains are deemed to be within the spirit, scope appended claims.

Referring to FIG. 1, there is shown at 10 a card holding means such as a strip member. The card holding means comprises at least one retaining means 12 located on one edge 14 of the card holding means. In the preferred embodiment, the strip retaining means are two slots 12, as shown in FIG. 1, with each slot having a wide portion 16 located in the body 20 of the card holding means or strip member 10, and a narrow portion 18 opening into the edge 14 of strip member 10 such that the card holding means may be inserted onto a pair of tracks or rails through its narrow portion 18 and retained by its wider portion 16.

The card holding means or strip member 10 further comprises a self adhesive section 24. In the preferred embodiment, the self adhesive section 24 is a strip located adjacent an edge 26 directly opposite to the edge along which the strip retaining means 12 are located, and further located on one face 30 of the card holding means 10. The self adhesive section 24 is protected by a removable section covering means 32 which completely covers the self adhesive section 24 when the card holding means 10 is not in use, as illustrated in FIG. 1 and is peeled off (as partially shown in FIG. 2) when the card holding means is to be used. In the preferred embodiment, when the self adhesive section 24 is a strip located adjacent one edge of the card holding means 10, the removable section covering means 32 is a paper strip which is removably placed over the self adhesive section.

As shown in FIG. 3, after the section covering means 32 is peeled away, a card such as a business card 40 can be permanently attached to the card holding means 10 by aligning the card 40 onto the card holding means 10 and pressing the back of the card onto and against the uncovered self adhesive section 24 until a firm bond is secured. In the preferred embodiment as shown in FIG. 3, the bottom of the card 40 has been aligned just above the upper portion of the strip retaining means 12. It will be appreciated that the business card 40 could be aligned at any location although the embodiment shown in FIG. 3 is preferred since it provides the shortest practical combined vertical height of the business card 40 and card holding means 10. Therefore, a card 40 can be easily and permanently retained on the card holding means 10.

In the preferred embodiment, the card holding means is a rectangular strip which is approximately the same length as a conventional business card. Conventional business cards are approximately three and one-half inches long and two inches high. In the preferred embodiment, the strip is approximately three and one-half inches long and one and one-eighth inches high. The two slots extend through the faces of the strip and extend out one edge. They are spaced apart such that the distance 15 between their centers is approximately one inch. This conforms to the distance between the longitudinal centerlines of the tracks on card retaining files such as those made by Eldon or Rolodex. In the preferred embodiment, the self adhesive section is a strip located on one face of the rectangular strip.

As illustrated in FIG. 4, one convenient method of storing a multiplicity of unused card holding means 10 is to detachably affix two such card holding means 10 to each other along one lengthwise edge by a perforated central strip 11. When the card holding means 10 are to be used, they are torn apart at the location of the perforated central strip 11.

Referring to FIG. 5, there is shown one embodiment of a card carrying case 50. The card carrying means or case 50 comprises at least one rail or track 52 which can accommodate the strip retaining means 12 of the card holding means 10. In the preferred embodiment as shown in FIG. 5, a pair of rods or tracks are aligned in generally parallel relationship to each other and spaced apart so that their longitudinal centerlines are approximately the same distance apart as the distance between the centers of the strip retaining means !2 on the card holding members 10. The configuration of the remainder of the card carrying means or case 50 is optional and one of many possible embodiments is illustrated in FIG. 5. In this embodiment, the card carrying case 50 comprises a front ledge 54, a bottom 56, a rear portion 58 and a flexible cover 60 which can be opened to permit insertion of the card holding means 10 (with or without business cards attached) and thereafter closed by folding the lower edge 61 of the cover 60 immediately behind the front ledge 54, thereby protecting the card holding means 10 and attached cards 40 inside the card carrying case 50. The rods or tracks are held in place by being affixed to the front ledge and rear portion of the card carrying case. As shown in FIG. 5, the card holding means 10 can be snapped into place on the rods or tracks 52 through the narrow portion 18 and held therein by the wider portion 16 of the strip retaining means 12.

As shown in FIG. 5, the card holding means 10 can be snapped into place on the rods or tracks 52 of the card carrying case 50 and retained thereon for ready use. At such time as a card holding means 10 is needed, it can be easily snapped out of its position in the card carrying case 50 and the card 40 can be permanently affixed to the card holding means 10 as previously described. As shown in FIG. 5, the internal height of the card carrying means 50 is large enough to accommodate a conventional business card affixed to the card holding member 10. Through this method, a card 40 can be immediately affixed to a card holding member 10 and thereafter movably and removably held in the card carrying case 50.

Upon return to the office or other location where the card retaining file is kept, the business cards can be removed from the card carrying case 50 and snapped into place in the card retaining file.

One possible embodiment of the card retaining means 60 is shown in FIGS. 6 and 7. The card retaining file must comprise at least one rail or track which can accommodate the strip retaining means or slots 12 of the card holding member 10. In the preferred embodiment, the card retaining means 60 is a file which has a pair of rods or tracks 62 which are aligned in generally parallel relationship to each other and spaced apart so that their longitudinal centerlines are approximately the same distance apart as the distance between the centers of the strip retaining means 12 on the card holding means 10. One additional feature on the card retaining file is a well or temporary card placement area 64 located at the front of the file. Cards can be placed in this area and later filed alphabetically. While the card retaining means 60 is shown in FIGS. 6 and 7 as an open tray, it will be appreciated that it can be an enclosed type file comparable to the ones commercially sold by Eldon Corporation.

Another possible embodiment of the card retaining means 70 is the rotary file shown in FIG. 8. Once again, the important component for purposes of the present invention is that the rotary card retaining file 70 comprises at least one rail or track 72 which can accommodate the strip retaining means 12 of the card holding member 10. In the preferred embodiment, the rotary card retaining means 70 is a file which has a pair of tracks 72 which are aligned in generally equidistant relationship to each other along a circular path and spaced apart so that their longitudinal centerlines are approximately the same distance apart as the distance between the centers of the strip retaining means 12 on the card holding means 10.

An alternative embodiment of the card retaining means 80 is shown in FIGS. 9 through 12. FIG. 9 is a perspective view of an open card retaining means 80 such as a card file tray. Also shown in FIG. 9 is a multiplicity of separator members 100 used to divide the cards along a specific order, such as alphabetical order. FIG. 10 is a top plan view of the card retaining means 80. FIG. 11 is a cross-sectional view taken along line 11—11 of FIG. 10. FIG. 12 is a cross-sectional view taken along line 12—12 of FIG. 10. The body of the card retaining means 80 is formed of one piece construction (as by plastic injection molding) and comprises a rear wall 82, a floor 84, a front wall 86 and a handle 88. In the preferred embodiment illustrated, the front wall 86 and the rear wall 82 are generally parallel to each other and are generally perpendicular to the floor 84. The handle 88 extends from the front wall 86 and is preferably offset at an angle thereto. A well 90 is formed by and bounded by the front wall 86, the floor 84 and the rear wall 82. The card retaining means must comprise at least one rail or track which can accommodate the strip retaining means or slots 12 of the card holding member 10. In the preferred embodiment, the card retaining means 80 comprises a pair of rods or tracks 92 and 94 respectively which are aligned in generally parallel relationship to each other and spaced apart so that their longitudinal centerlines are approximately the same distance apart as the distance between the centers of the strip retaining means 12 on the card holding means 10. The pair of rods 92 and 94 are aligned in the well 90 and as illustrated in FIG. 12 extend for the entire length of the well 90 from the front wall 86 to the rear wall 82. As shown in FIG. 11, in the preferred embodiment the rods are part of the one piece construction of the front wall, floor and side wall, and extend upwardly from the floor. Rod 92 is supported on stem 96 which extends from floor 84 and rod 94 is supported on stem 98 which extends from floor 84. In each case, the rod 92 is offset from the stem 96 so that one portion of the circumference of each rod is aligned with the inwardmost portion of its supporting stem, as shown in FIG. 11. Of course, it is also possible for the rod to be centered on its supporting stem. Alternatively, the rods could be merely cylindrical tubes which are supported by the front and rear walls, comparable to the illustration of the embodiment shown in FIG. 7. The card holding means 10 and associated cards 40 (or card holding means alone) are supported on the rods 92 and 94 as previously described.

As part of the system of the presently invention, the card retaining means 80 can itself be retained within a housing member whose interior dimensions are design to accommodate the card retaining means 80 when it is filled with card holding means 10 and associated cards 40. A preferred embodiment of such a housing member 110 is illustrated in FIG. 13. The housing member 110 is comprised of an open faced chamber which includes and is bounded by a pair of generally parallel and oppositely disposed side walls 112 and 114 and a pair of generally parallel and oppositely disposed walls 116 and 118 which serve as the top and bottom walls respectively. A rear wall 120 completes the chamber which is completely open on its front surface area 122. In the preferred embodiment, all of the walls 112, 114, 116, 118 and 120 are created in a one-piece construction (such as by plastic injection molding) and essentially form a box which is open on one face. The embodiment shown in FIG. 13 is generally square, but other shapes such as rectangular with walls 112, 114, 116, and 118 being longer than wall 120 are within the spirit and scope of the present invention. The interior surface of side walls 112 and 114 further comprise a pair of rails or shelves. Interior surface 113 of side wall 112 comprises a pair of rails or shelves 124 and 126. As illustrated in FIG. 14, each rail or shelf 124 and 126 abuts rear wall 120 and extends forward to a distance adjacent but not at the front opening 122. The interior surface of side wall 114 also comprises a pair of rails or shelves 128 and 130 which are oppositely disposed to the rails or shelves 124 and 126, and are parallel to them, to thereby form two sets of rails. Lower rails 124 and 128 are oppositely disposed and parallel to each other. Upper rails 126 and !30 are oppositely disposed and parallel to each other. Rails 124 and 126 are generally parallel to each other and as illustrated in FIG. 14 are set apart by a distance slightly larger than the height of rear wall 82 of card retaining member 80. Rails 128 and 130 are generally parallel to each other and are set apart by a distance slightly larger than the height of rear wall 82 of card retaining member 80. As shown in FIG. 14, the distance between lower rails 124 and 128 and the floor 118 is set so that the card retaining means 80 filled with card holding means 10 and associated cards 40 and separator members 100 can fit within the interior space 130 of housing means 110. The card retaining means 80 is inserted into the housing means 110 such that the respective edges of the floor 84 slidably rest on a respective one of the lower rails protruding from the interior sidewalls of the housing means 110 and such that the respective edges of the rear wall 82 abuts a respective one of the lower surfaces of the upper rails protruding form the interior sidewalls of the case member, as illustrated in FIG. 14. The rails 124, 126, 128 and 130 protrude only a sufficient distance so as to provide support for the floor 84 and stabilization on the rear wall 82, and not so far into the space 132 so as to interfere with the business cards 40 or separator members 100.

In the space 134 between the floor 118 and the lower pair of rails 124 and 128, the housing member 110 further comprises a slidable tray 140 whose dimensions are designed to fit within space 134. The upper portion of the sidewalls of tray 140 abut the lower portions of lower rails 124 and 128 such that the tray 140 can slide in and out of the housing member or means 110 along its floor 118. The tray can be used to hold business cards 40 which have not yet been filed in the card retaining means 80.

As shown in FIG. 14, the card retaining means 14 is inserted such that the handle 88 protrudes from the open surface 122. It is also within the spirit and scope of the present invention to make the housing member 1!0 sufficiently deep to accommodate the handle within the space 132 such that the handle 88 does not protrude from the case member 110.

Several optional features help make the housing member 110 more accessible and easier to use. A least one opening in the rear wall 120 serves to provide a means for mounting the housing member 110 on a wall or other surface. In the illustration in FIG. 13, the rear wall 120 of housing member 110 includes a pair of openings or mounting means 121 and 123 by which the housing member can be mounted on a wall or other surface (through hooks, nails or comparable apparatus).

The housing member 110 may also include a multiplicity of stacking means 127 such as Bumpons~ located on the lower surface 118, as illustrated in FIG. 14. In the preferred embodiment, there are four stacking means 127, with one located adjacent each corner on the lower surface of the housing member. In this way, the Bumpons~ provide a nonslip surface by which the housing members can be stacked one on top of the other. Comparable stacking means or Bumpons~ 129 can be located on the lower such of the card retaining means 50 (as illustrated in FIG. 14) to enable them to be more easily used on a surface, as the Bumpons~ 129 provide a nonslip surface.

Therefore, through the case member as described, the present invention includes an entire system which comprises the card holder member, the card carrying means, the card retaining means and the housing member or means.

The housing member and its associated components can be made of plastic or any other suitable material such as pressed cardboard or styrofoam.

An additional element of the system is a matching case means which permits a multiplicity of card carrying means to be stored and carried in a preselected order. The case means 150 is illustrated in FIG. 15 and includes a conventional case comprising a rectangular shaped base 152 having a floor and four walls and defining an interior space 154 therein. The case 150 is closed by a lid 160 which can be hingeably attached to the base 150 at end one. The interior space 154 is partitioned into a multiplicity of slots 162, each of which is shaped in the same configuration as a card carrying means and is just large enough to accommodate one card carrying means 50. In the preferred embodiment, the space 154 is partitioned into two parallel rows of slots as illustrated in FIG. 15. The slots can be formed of styrofoam, rubber, or other insert material which can be individually formed and then inserted into the case means 150. Alternatively, the slots can be made of wood or comparable material and built into the case means 150. The case means 150 may include a handle 156.

As a result, if it is desired to select a group of cards retained by the present invention card holding means and carrying them on a business trip, the user can remove the business cards and associated card holding means from the card retaining means and place them in the card carrying member. If it is desired to have a preselected group of card carrying means on the trip so that each card carrying means contains a group of cards for businesses or individuals to be called on during a given period of time or a given location, the matching case means 150 can hold a multiplicity of card carrying means 50 within each of the respect slots 162 in a preselected order with the associated preselected business cards therein. In this way, a business trip can be efficiently organized with the cards for individuals or business to be called on in a given morning placed in one card carrying means 50 and the cards for individuals or businesses to be called on in the afternoon and during future days to be placed in selected additional card carrying means.

One alternative embodiment to the card carrying case 50 is to carry the business cards 40 in an alternative embodiment of the present invention which is designed to be used in conjunction with a conventional loose-leaf planner or organizer. This embodiment is illustrated in FIG. 16. The planner card carrying means 200 comprises a back sheet 202 which can be made of plastic, cardboard, or comparable suitable material, and which is generally rectangular in shape and is dimensioned to fit into a conventional loose-leaf planner or organizer. The back sheet 202 includes a multiplicity of holes 204 adjacent one longitudinal edge and aligned to fit onto the rings of the loose-leaf planner. The preferred embodiment is three holes 204 as illustrated in FIG. 16, but any embodiment with two or more holes is within the spirit and scope of the present invention. At the opposite longitudinal edge and protruding from one lateral face of the back sheet 202 is at least one but preferably a pair of card retaining sections 205 each of which includes a front ledge or face 206, a bottom 208 and a rear wall parallel to the front wall 206, which rear wall may be a portion of the backing sheet 202. Each card carrying section further comprises at least one rail or track which can accommodate the strip retaining means 12 of the card holding means 10. In the preferred embodiment as shown in FIG. 16, each section 205 has a pair of rods or tracks 210 and 212 which are aligned in generally parallel relationship to each other and spaced apart so that their longitudinal centerlines are approximately the same distance apart as the distance between the centers of the strip retaining means 12 on the card holding means 10. The rods or tracks 210 and 212 are supported by the front wall 206 and the portion of the back sheet 202 parallel to the front wall 206. In the embodiment illustrated in FIG. 16, there are two such sections 205, but it will be appreciated that any multiplicity of sections are within the spirit and scope of the present invention and are limited only by the design of the planner or organizer for which the particular embodiment is designed. In the illustration shown in FIG. 16, the two sections 205 are aligned adjacent each other, however, they can also be aligned one above the other if the width of the back sheet 202 for the particular embodiment has sufficient room to permit this design.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus and method shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A card holding, carrying, retaining, and housing system comprising:

a. a card holding means further comprising, (i) a rectangularly shaped strip of material having a first edge and a second edge oppositely disposed to each other, (ii) said strip of material having two sections, with a first section terminating in said first edge and a second section terminating in said second edge, (iii) a self adhesive section located on one face of said first section, located adjacent said first edge, and protected by a removable section covering means when said card holding means is not in use to hold a card, (iv) a first retaining means located in said second section, the first retaining means forming a slot having a wide portion located within the second section of said rectangularly shaped strip of material and a narrow portion extending from the wide portion and opening out of said second edge of said rectangularly shaped strip of material, (v) a second retaining means located in said second section, the second retaining means forming a slot having a wide portion located within the second section of said rectangularly shaped strip of material and a narrow portion extending from the wide portion and opening out of said second edge of said rectangularly shaped strip of material, the second retaining means being spaced apart from and generally parallel to said first retaining means;

b. a generally rectangular card carrying means further comprising, (i) a front ledge, (ii) a bottom attached to the front ledge along one edge, (iii) a rear portion attached to the bottom along the opposite edge of the bottom, (iv) a flexible cover attached to the opposite edge of the rear portion, which flexible cover can be opened to permit insertion of the card holding means, (v) a pair of spaced apart generally parallel tracks whose longitudinal centerlines are spaced apart by approximately the same distance as the longitudinal centerlines of said first retaining means and said second retaining means of said card holding means, the tracks being supported by and between the front ledge and the rear portion of the generally rectangular card carrying case, and the tracks being accessible to insertion and removal of said first retaining means and said second retaining means;

d. said first retaining means configured to be removably retained by one of said spaced apart generally parallel tracks of said card carrying means and said second retaining means configured to be simultaneously removably retained by the second of said spaced apart generally parallel tracks of said card carrying means, and further configured so that the first and second retaining means can be reattached on their respective tracks;

e. a card retaining means further comprising, (i) a rear wall and a front wall generally parallel to each other and each being generally perpendicular to a floor to thereby create a well between the rear wall and the front wall, (ii) said front wall further including a handle member attached thereto, (iii) a pair of spaced apart generally parallel tracks extending from said front wall to said rear wall within said well, the longitudinal centerlines of the tracks being spaced apart by approximately the same distance as the longitudinal centerlines of said first retaining means and said second retaining means of said card holding means;

f. said first retaining means configured to be removably retained by one of said spaced apart generally parallel tracks of said card retaining means and said second retaining means configured to be simultaneously removably retained by the second of said spaced apart generally parallel tracks of said card retaining means;

g. a housing means for movably retaining said card retaining means and associated card holding means therein, the housing means further comprising, (i) an open faced chamber bounded by a pair of generally parallel and oppositely disposed side walls constituting a first side wall and a second side wall, a pair of generally parallel and oppositely disposed walls forming a top wall and a bottom wall, and a rear wall, (ii) a first lower track attached to and running adjacent said first side wall and located within said chamber and a first upper track attached to and running adjacent said first side wall and located within said chamber and set at a distance above the first lower track, (iii) a second lower track parallel to said first lower track and attached to and running adjacent said second side wall and located within said chamber and a second upper track parallel to said first upper track and attached to and running adjacent said second side wall and located within said chamber and set at a distance above the second lower track; and h. said card retaining means inserted into said chamber of said housing means through its open face such that said floor of the card retaining means slides on said first lower track and said second lower track and the upper portion of said rear wall of said card retaining means rests just below said first upper track and said second upper track, and wherein said card retaining means and associated card holding means and cards are slidably received within said chamber;

i. whereby a card can be attached to said card holding means by removing said removable section covering means and bonding the card to the self adhesive section such that the card extends past said first edge of said strip but does not extend to the location of said first retaining means and said second retaining means, and the card holding section can be movably and removably inserted on said pair of tracks located in said generally rectangular card carrying means at any desired location in front of or behind any other multiplicity of card holding means and cards retained thereon already in place on the pair of tracks through said first retaining means and said second retaining means of said strip of material located on a respective one of the pair of tracks and can be carried in the card carrying means until the card holding means and associated card are brought to the card retaining means at which time the card holding means and associated card are removed from the card carrying means and thereafter movably and removably inserted on said pair of tracks located in said card retaining means at any desired location in front of or behind any other multiplicity of card holding means and cards retained thereon already in place on the pair of tracks through said first retaining means and said second retaining means of said card holding means, and said card retaining means is slidably balanced between the lower pair of tracks and the upper pair of tracks of said housing means in a manner whereby the cards are entirely within the chamber of said housing means.

2. The system in accordance with claim 1 wherein said housing means further comprises mounting means to enable the housing means to be mounted on a surface.

3. The system in accordance with claim 1 wherein said housing means further comprises stacking means to enable the housing means to be stacked on top of a second housing means.

4. The system in accordance with claim 1 further comprising:

a. said first lower track and said second lower track of said housing means are each set at a distance above the bottom wall of said housing means; and b. a slidable tray which is slidably received within the area of the chamber of said housing means between said first lower track and said second lower track and the the bottom wall;

c. whereby unused card holding means and unfiled cards may be retained within said slidable tray until they can be filed onto said card retaining means.

5. A card holding, carrying and case retaining system comprising:

a. a card holding means further comprising, (i) a rectangularly shaped strip of material having a first edge and a second edge oppositely disposed to each other, (ii) said strip of material having two sections, with a first section terminating in said first edge and a second section terminating in said second edge, (iii) a self adhesive section located on one face of said first section, located adjacent said first edge, and protected by a removable section covering means when said card holding means is not in use to hold a card, (iv) a first retaining means located in said second section, the first retaining means forming a slot having a wide portion located within the second section of said rectangularly shaped strip of material and a narrow portion extending from the wide portion and opening out of said second edge of said rectangularly shaped strip of material, (v) a second retaining means located in said second section, the second retaining means forming a slot having a wide portion located within the second section of said rectangularly shaped strip of material and a narrow portion extending from the wide portion and opening out of said second edge of said rectangularly shaped strip of material, the second retaining means being spaced apart from and generally parallel to said first retaining means;

b. a generally rectangular card carrying means further comprising, (i) a front ledge, (ii) a bottom attached to the front ledge along one edge, (iii) a rear portion attached to the bottom along the opposite edge of the bottom, (iv) a flexible cover attached to the opposite edge of the rear portion, which flexible cover can be opened to permit insertion of the card holding means, (v) a pair of spaced apart generally parallel tracks whose longitudinal centerlines are spaced apart by approximately the same distance as the longitudinal centerlines of said first retaining means and said second retaining means of said card holding means, the tracks being supported by and between the front ledge and the rear portion of the generally rectangular card carrying case, and the tracks being accessible to insertion and removal of said first retaining means and said second retaining means;

c. said first retaining means configured to be removably retained by one of said spaced apart generally parallel tracks of said card carrying means and said second retaining means configured to be simultaneously removably retained by the second of said spaced apart generally parallel tracks of said card carrying means, and further configured so that the first and second retaining means can be reattached on their respective tracks; and d. a case means further comprising, (i) a floor and four walls defining an interior space and a cover therefor, (ii) said interior space further including a partition means to thereby partition the interior space into a multiplicity of slots, each of which is shaped in the same configuration as said card carrying means and sufficiently large to accommodate one card carrying means in a given slot;

e. whereby a card can be attached to said card holding means by removing said removable section covering means and bonding the card to the self adhesive section such that the card extends past said first edge of said strip but does not extend to the location of said first retaining means and said second retaining means, and the card holding section can be movably and removably inserted on said pair of tracks located in said generally rectangular card carrying means at any desired location in front of or behind any other multiplicity of card holding means and cards retained thereon already in place on the pair of tracks through said first retaining means and said second retaining means of said strip of material located on a respective one of the pair of tracks and can be carried in the card carrying means, and subsequently a given number of the card carrying means may be retained in and carried in said card case means.

6. A card holding and carrying system comprising:

a. a card holding means further comprising, (i) a rectangularly shaped strip of material having a first edge and a second edge oppositely disposed to each other, (ii) said strip of material having two sections, with a first section terminating in said first edge and a second section terminating in said second edge, (iii) a self adhesive section located on one face of said first section, located adjacent said first edge, and protected by a removable section covering means when said card holding means is not in use to hold a card, (iv) a first retaining means located in said second section, the first retaining means forming a slot having a wide portion located within the second section of said rectangularly shaped strip of material and a narrow portion extending from the wide portion and opening out of said second edge of said rectangularly shaped strip of material, (v) a second retaining means located in said second section, the second retaining means forming a slot having a wide portion located within the second section of said rectangularly shaped strip of material and a narrow portion extending from the wide portion and opening out of said second edge of said rectangularly shaped strip of material, the second retaining means being spaced apart from and generally parallel to said first retaining means;

b. a card carrying means further comprising, (i) a generally rectangular shaped back sheet including a multiplicity of holes adjacent one longitudinal edge and aligned to fit onto the rings of a loose-leaf planner, (ii) at least one card retaining section comprising, (a) a front ledge, a bottom and a portion of said back sheet serving as the rear wall, (b) a pair of tracks aligned in generally parallel relationship to each other and spaced apart so that their longitudinal centerlines are approximately the same distance apart as the distance between the longitudinal centerlines of said first retaining means and said second retaining means of said card holding means, the pair of tracks being supported between the front ledge and the rear wall, and the tracks being accessible to insertion and removal of said first retaining means and said second retaining means; and c. said first retaining means configured to be removably retained by one of said spaced apart generally parallel tracks of said card carrying means and said second retaining means configured to be simultaneously removably retained by the second of said spaced apart generally parallel tracks of said card carrying means, and further configured so that the first and second retaining means can be reattached on their respective tracks.

* * * * *